US006640556B2

(12) United States Patent
Ursan et al.

(10) Patent No.: US 6,640,556 B2
(45) Date of Patent: Nov. 4, 2003

(54) METHOD AND APPARATUS FOR PUMPING A CRYOGENIC FLUID FROM A STORAGE TANK

(75) Inventors: Mihai Ursan, Burnaby (CA); Anker Gram, Vancouver (CA)

(73) Assignee: Westport Research Inc., Vancouver (CA)

( * ) Notice: Subject to any disclaimer, the term of this patent is extended or adjusted under 35 U.S.C. 154(b) by 39 days.

(21) Appl. No.: 09/955,825

(22) Filed: Sep. 19, 2001

(65) Prior Publication Data

US 2003/0051486 A1 Mar. 20, 2003

(51) Int. Cl.[7] ..... F17C 13/00
(52) U.S. Cl. ..... 62/50.6; 62/50.7
(58) Field of Search ..... 62/48.1, 50.1, 62/50.4, 50.6, 50.7

(56) References Cited

U.S. PATENT DOCUMENTS

| | | | |
|---|---|---|---|
| 4,086,518 A | 4/1978 | Wilkinson | 318/127 |
| 4,239,460 A | 12/1980 | Gölz | 417/251 |
| 5,056,036 A | 10/1991 | Van Bork | 364/510 |
| 5,477,690 A | 12/1995 | Gram | 62/45.1 |
| 5,537,828 A | 7/1996 | Borcuch et al. | 62/50.1 |
| 5,575,626 A | 11/1996 | Brown et al. | 417/251 |
| 5,884,488 A | 3/1999 | Gram et al. | 62/50.6 |
| 6,006,525 A | 12/1999 | Tyree, Jr. | 62/50.6 |

*Primary Examiner*—William C. Doerrler
*Assistant Examiner*—Malik N. Drake
(74) *Attorney, Agent, or Firm*—Mcandrews, Held & Malloy, Ltd.

(57) ABSTRACT

In the present method and apparatus, cryogenic liquid and vapor are pumped from a storage tank and the proportion of liquid and vapor is controlled so as to influence flow rate through the apparatus. In an induction stroke, the piston of a reciprocating pump is retracted and cryogenic fluid is drawn from the storage tank into a piston chamber associated with the piston. Flow rate is controlled through the apparatus by controlling the proportion of liquid and vapor supplied to the pump during the induction stroke by supplying substantially only vapor to the pump during a portion of the induction stroke. In a compression stroke, the pump compresses and condenses vapor into liquid and then compresses any liquid within the piston chamber; compressed cryogenic fluid is ultimately discharged from the pump. The apparatus preferably includes a pump with a liquid supply line connecting a pump inlet to a storage tank, a vapor supply line connecting an ullage space with a pump inlet, an automatically actuated valve that opens and closes to control the flow of vapor to the pump inlet, and a controller that controls the valve to achieve a desired flow rate.

43 Claims, 4 Drawing Sheets

METHOD AND APPARATUS FOR PUMPING A CRYOGENIC FLUID FROM A STORAGE TANK

FIELD OF THE INVENTION

This invention relates in general to a method and apparatus for pumping a cryogenic fluid from a storage tank. The apparatus comprises a reciprocating pump and the method comprises controlling pump flow rate and vapor pressure within the storage tank by controlling the proportion off cryogenic liquid and vapor supplied to the pump during the induction stroke.

BACKGROUND OF THE INVENTION

Cryogenic fluids are defined as liquids that boil at temperatures of less than about 200° Kelvin at atmospheric pressure, such as hydrogen, helium, nitrogen, oxygen, natural gas or methane.

For containing cryogenic fluids, vacuum insulated storage tanks are known. For example, liquefied natural gas (LNG) at pressures of between about 15 and 200 psig (about 204 and 1580 kPa) can be stored at temperatures of between about 120° K and 158° K in vacuum insulated storage tanks.

A problem with known storage tanks is that heat leaks can cause vaporization of some of the cryogenic fluid within the storage tank and this reduces the time that cryogenic fluids can be held within such storage tanks. To prevent the vapor pressure from rising to undesirable pressures, cryogenic storage tanks are normally equipped with a pressure relief valve. When the vapor pressure rises to above the set point for the relief valve, the storage tank is vented. There is a need for a system that reduces the need for venting, since it may be undesirable to release some cryogenic fluids into the atmosphere and since venting is wasteful of cryogenic fluid.

Some cryogenic fluids such as hydrogen, natural gas, and methane are usable as fuels in internal combustion engines. In some engines, improved efficiency and emissions can be achieved if the fuel is injected directly into the cylinders under high pressure at the end of the compression stroke of the piston. The fuel pressure needed to inject fuel directly into the engine cylinder in this manner can be 3000 psig (about 23,700 kPa), or higher, depending upon the engine design. Accordingly, the cryogenic fuel cannot be delivered directly from a conventional storage tank and an apparatus is needed for delivering a cryogenic fluid to the engine at such high pressures. A pump is required to boost the pressure from storage pressure to injection pressure and to remove vapor from the storage tank to reduce the need for venting.

U.S. Pat. No. 5,411,374, and its two divisional patents, U.S. Pat. Nos. 5,477,690 and 5,551,488, disclose embodiments of a cryogenic fluid pump system and method of pumping cryogenic fluid. In one embodiment the disclosed double-acting piston pump may be employed as a mobile vehicle fuel pump. In this embodiment, the pump is employed to remove both cryogenic vapor and liquid from the tank in a manner whereby only liquid is removed when the pressure in the surge tank is low and vapor starts to be removed when pressure in the surge tank is sufficiently high for engine demand and the vapor pressure in the vehicle tank is higher than the set point. The cryogenic liquid and vapor are supplied from a storage tank through respective conduits communicating between the tank and the pump inlet. A liquid control valve is associated with the liquid supply conduit and a vapor control valve is associated with the vapor supply conduit. The liquid and vapor control valves are controlled in response to fuel demand and the vapor pressure measured within the cryogenic storage tank.

Co-owned U.S. Pat. No. 5,884,488, which is hereby incorporated by reference herein in its entirety, discloses a high-pressure fuel supply system for supplying cryogenic fluid from a storage tank to an engine. The '488 patent discloses, among other things, a multi-stage LNG pump that is capable of pumping liquid or a mixture of liquid and vapor. A metering valve is adjustable to control the amount of vapor drawn into the pump suction. In another embodiment, an orifice is provided in the vapor supply line for regulating the amount of vapor induced into the sump for the LNG pump. The technique disclosed herein permits increased holding times in the storage tank by providing a method and apparatus for removing vapor from the storage tank.

SUMMARY OF THE INVENTION

In the present method, cryogenic liquid and vapor is pumped from a storage tank with a reciprocating piston pump. The method comprises:

(a) In an induction stroke,
- retracting a piston within the reciprocating pump and drawing cryogenic fluid from the storage tank into a piston chamber associated with the piston;
- controlling flow rate through the pump by controlling the proportion of liquid and vapor supplied to the pump by supplying substantially only vapor during a selected portion of the induction stroke; and (b) in a compression stroke, compressing and condensing any vapor and compressing any liquid within the piston chamber, and discharging compressed cryogenic fluid from the pump.

In a preferred method, flow rate through the pump is controlled to maintain pressure within a predetermined range at a point downstream from the pump. For example, the point downstream from the pump may be in an accumulator vessel, in a pipe, or in a manifold of a fuel system leading to an engine.

The method may further comprise monitoring vapor pressure within the storage tank and further controlling the proportion of vapor and liquid supplied to the pump to maintain vapor pressure within the storage tank below a predetermined value. For example, by changing pump speed, a constant flow rate may be maintained, while changing the proportion of liquid and vapor supplied to the pump. Similarly, when pressure downstream from said pump is within the desired predetermined range, the proportion of vapor supplied to the pump may be increased to reduce vapor pressure within the storage more quickly.

The proportion of liquid and vapor supplied to the pump during the induction stroke may be controlled by first supplying liquid until the piston reaches a position during the induction stroke that corresponds to a desired proportion of liquid and then supplying substantially only vapor to fill the piston chamber until the induction stroke is complete.

In a preferred embodiment, for each pump cycle, the minimum flow rate pumpable through the pump is determined by the minimum proportion of liquid that is needed during the compression stroke to allow condensation of the vapor within the piston chamber.

A liquefied gas occupies much less space than the same fluid in the gaseous state, so a storage space advantage may be realized by applications that use cryogenic systems to supply a gas. For high-pressure applications a cryogenic pump may be employed. After the liquefied gas is discharged from a cryogenic pump, the fluid may be directed to a heater for transforming it into a gas.

In one embodiment of the method, the desired proportion of liquid, measured by volume, is constant in each pump cycle. To achieve a constant proportion of liquid, vapor is supplied to the pump during a predetermined portion of the induction stroke. For example, liquid may be supplied to the pump initially from the beginning of the induction stroke and whenever the piston reaches a predetermined position, vapor is then supplied to the pump for the remainder of the induction stroke. The same result could be achieved by supplying substantially only vapor to the pump during any predetermined constant portion of the induction stroke, and substantially only liquid during the rest of the induction stroke.

When the cryogenic fluid is a combustible fuel, the present method may be employed to supply fuel to an engine.

In one embodiment, the supply of vapor to the piston chamber during the induction stroke is controlled by operating an automatically actuated valve associated with a vapor supply pipe that connects an ullage space of the tank with the pump. The method comprises opening the valve to supply substantially only vapor to the pump and closing the valve to supply substantially only liquid. The flow rate through the pump is controlled by controlling when the valve is opened with reference to the position of the piston, and flow rate is increasable by opening the valve for a smaller portion of the induction stroke. The position of the pump piston is determined by a sensor that sends an electronic signal to an electronic controller. The sensor may comprise a linear position transducer associated with the piston. Suitable means for automatically actuating the valve are well known. For example, the actuator may be electronic, mechanical, pneumatic, hydraulic, or a combination these. A mechanical actuator may be set to automatically actuate the valve for a constant portion of the induction stroke.

In a preferred embodiment, the valve actuator is electronically controlled and the proportion of liquid and vapor supplied to the pump is variable from one induction stroke to the next. For example, an electronic controller may be employed to open and close a solenoid actuated valve for directing vapor to the pump and achieving a desired pump flow rate. By supplying vapor from the ullage space of the storage tank to the pump, vapor pressure within the storage tank is reduced.

An advantage of the present technique is that a metering valve or orifice is not required to control the amount of vapor that flows through the vapor supply pipe. Instead, according to the present method, the proportion of vapor may be controlled in each individual induction stroke.

In a preferred method, a linear hydraulic motor drives the pump. A linear hydraulic motor is preferred compared to a mechanical crankshaft drive since a linear hydraulic motor can be used to operate the pump at a constant speed and this reduces pressure pulses in the discharge pipe. When the method is employed for supplying fuel to an engine, mechanical energy from the engine may be efficiently used for powering a hydraulic pump for the hydraulic motor.

When a linear hydraulic motor drives the pump, the position of the pump piston may be determined by monitoring the hydraulic motor. In another embodiment, the position of the pump piston is determined by monitoring a reference point associated with the piston rod disposed between the pump piston and the linear hydraulic motor.

When the method employs a single stage pump, at a given pump speed, the apparatus can be controlled to operate at a maximum flow rate by supplying only liquid to the pump during the induction stroke. When the pump is equipped with an inducer, an amount of vapor may still be supplied to the pump when the pump operates at a maximum flow rate because the vapor is condensed in the inducer. With an inducer, for each cycle, maximum flow rate is achievable by supplying a proportion of liquid and vapor to the inducer such that all of the vapor supplied to the inducer is condensable by the inducer and liquid discharged from the inducer fills the pump piston chamber.

In another embodiment, the proportion of liquid and vapor supplied to the pump may be controlled by controlling the flow rate of the liquid supplied to the pump. For example, when vapor is not being supplied to the pump a flow control valve associated with the liquid supply pipe may be operated to control the flow rate of liquid flowing from the storage tank to the pump. Accordingly, for a pump that is configured to supply vapor to the pump for a constant portion of the induction stroke, the proportion of liquid and vapor supplied to the pump is controllable by controlling the flow rate of the liquid supplied to the pump.

In addition to controlling flow rate by controlling the proportion of liquid and vapor supplied to the pump, flow rate through the pump may be further influenced by employing a variable displacement pump or by changing pump speed. For example, when the pump is driven by a hydraulic motor, a variable speed controller can be used to change pump speed. In arrangements where the hydraulic pump or the cryogenic pump itself is driven by an engine that is supplied with fuel by the cryogenic pump, engine speed generally correlates to fuel demand and the pump speed can be controlled to automatically increase with increased engine speed. However, in this arrangement, a hydraulic motor with a hydraulic pump driven by the engine has an advantage over a cryogenic pump directly driven by the engine, because the hydraulic motor permits the pump speed to be controlled to reduce pressure pulses in the discharge pipe.

When a variable displacement cryogenic pump is employed, flow rate through the pump may be further controlled by changing pump displacement, for example, by limiting the stroke when a lower flow rate is desired. Persons skilled in the technology involved here will understand that many methods of controlling flow rate through the pump may be combined with the disclosed method of controlling flow rate by controlling the proportion of cryogenic vapor and liquid supplied to the pump.

A specific preferred method of pumping a cryogenic fluid from a storage tank with a reciprocating piston pump comprises:

(a) in an induction stroke,
- retracting a piston within the reciprocating pump and drawing cryogenic fluid from the storage tank into a piston chamber associated with the piston;
- supplying vapor from the storage tank to the pump through a vapor supply pipe when a valve associated with the vapor supply pipe is open;
- supplying cryogenic liquid from the storage tank to the pump through a liquid supply pipe when the valve is closed; and
- reducing vapor pressure within the storage tank and controlling pump flow rate by controlling the timing for opening the valve during the induction stroke; and (b) in a compression stroke,
- reversing the direction of the piston to compress and condense vapor and compress the cryogenic liquid within the piston chamber; and discharging compressed cryogenic fluid from the pump.

When the pump induces liquid at the beginning of the next induction stroke, the valve associated with the vapor supply pipe is closed prior to the next induction stroke. The valve may be closed upon completion of the compression stroke or at any time during the compression stroke. Obviously, when the vapor is supplied at the beginning or during the middle of the induction stroke the valve is closed prior to the end of the induction stroke.

The present technique is further directed to an apparatus for carrying out the method of pumping a cryogenic fluid from a storage tank and reducing vapor pressure within the storage tank. In a preferred embodiment, the apparatus comprises:

(a) a reciprocating pump for pumping the cryogenic fluid supplied from the storage tank;

(b) a liquid supply pipe that fluidly connects the storage tank to an inlet of the pump;

(c) a vapor supply pipe that fluidly connects an ullage space within the storage tank to the inlet;

(d) an automatically actuated valve associated with the vapor supply pipe, the valve being operable between a closed and an open position for allowing vapor to flow through the vapor supply pipe when the valve is in the open position; and (e) a controller for determining when to open the valve during an induction stroke of the pump, the controller making such determination to achieve a desired flow rate.

The apparatus may further comprise a position sensor for determining the position of a piston of the pump. The position sensor communicates with the controller so that the controller opens the valve when the piston is in a position that corresponds to the desired proportion of liquid for the induction stroke. In a preferred arrangement, the position sensor comprises a linear position transducer associated with the piston.

The reciprocating pump may further comprise an inducer. The inducer is fluidly disposed between the storage tank and the reciprocating pump. The inducer comprises an inlet for receiving cryogenic fluid from the storage tank, an inducer piston that is reciprocable within an inducer piston chamber for compressing and condensing cryogenic vapor and compressing cryogenic liquid, and an outlet for discharging the compressed cryogenic fluid. The cryogenic fluid compressed by the inducer is then supplied to the inlet of the pump for further compression of the cryogenic fluid.

In a preferred arrangement of the inducer, the inducer piston divides the inducer piston chamber into two sub-chambers so that the inducer operates with two stages. Cryogenic liquid is transferred from the first piston chamber to the pump piston chamber through a one-way flow conduit, which is typically a check valve. A pressure-actuated valve allows cryogenic fluid to flow from the inducer's second stage to the first stage when pressure within the second stage exceeds a predetermined value. That is, during the compression stroke of the second stage, cryogenic liquid is transferred from the second stage sub-chamber to the pump piston chamber, and when the pump piston chamber is filled, the pressure within the second stage sub-chamber rises until the pressure actuated valve opens to return the excess fluid to the inducer's first stage sub-chamber. Such a two-stage inducer configuration allows excess cryogenic fluid to be recycled within the inducer instead of being returned to the storage tank.

Cryogenic pumps comprising inducers are described in more detail and illustrated in co-owned U.S. Pat. No. 5,884,488, which has been incorporated herein by reference in its entirety. The pump piston chamber is preferably volumetrically smaller than the inducer piston chamber. More particularly, the inducer piston chamber preferably has a volume that is at least two times larger than the volume of the pump piston chamber, and in a preferred embodiment, the inducer piston chamber has a volume that is between about four and seven times larger than the volume of the pump piston chamber.

BRIEF DESCRIPTION OF THE DRAWINGS

The drawings illustrate specific embodiments of the invention, but should not be construed as restricting the spirit or scope of the invention in any way.

DETAILED DESCRIPTION OF PREFERRED EMBODIMENT(S)

Figure 1:
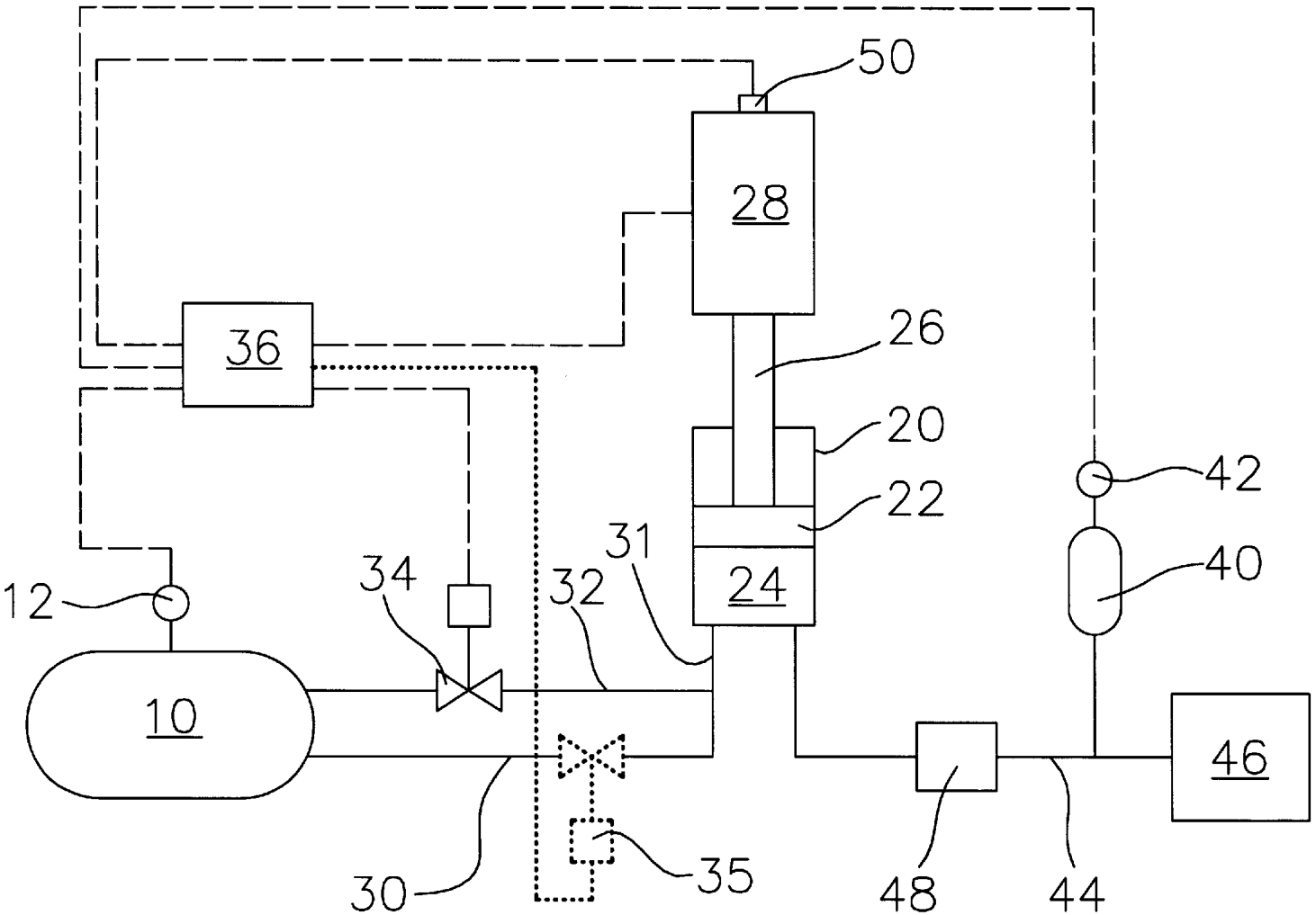
FIG. 1 is a schematic illustration of an apparatus for pumping a cryogenic fluid from a storage vessel to an accumulator vessel.

With reference to FIG. 1, which is a schematic illustration of a preferred apparatus for pumping a cryogenic fluid from storage vessel 10 to accumulator vessel 40. Pressure sensor 12 measures the pressure within storage tank 10 and pressure sensor 42 measures the pressure within accumulator vessel 40. In another embodiment not illustrated, the apparatus need not employ accumulator vessel 40 and pressure sensor 42 simply measures pressure in discharge pipe 44.

While the apparatus will be described with reference to single acting reciprocating piston pump 20, which comprises piston 22, piston chamber 24, piston rod 26 and linear actuator 28, to pump the cryogenic fluid to higher pressures, it will be understood that a pump with an inducer or a multi-stage pump may be substituted for pump 20 or a separate second stage pump may be employed in series with pump 20. For example, pump 20 may be substituted in FIG. 1 with a pump such as one of those described in co-owned U.S. Pat. No. 5,884,488. In a preferred embodiment, linear actuator 28 is a linear hydraulic motor.

Liquid is supplied from storage tank 10 to piston chamber 24 through liquid supply pipe 30, pump suction pipe 31, and a pump inlet. Vapor is supplied to the same pump suction pipe 31 and pump inlet from the ullage space in storage tank 10 through separate vapor supply pipe 32. Valve 34 is shown disposed along vapor supply pipe 32 to control the flow of vapor through vapor supply pipe 32. Valve 34 is an automatically actuated valve. In a preferred embodiment, valve 34 is a solenoid valve, but valve 34 could also employ another type of automatic actuator, such as a pneumatic actuator or a mechanical actuator (for example, a shaft driven cam). When valve 34 is open, the lower resistance for vapor flow compared to liquid flow results in substantially only vapor being supplied to piston chamber 24 through pump suction pipe 31. Therefore, when valve 34 is open, a control valve is not required to stop the flow of liquid through liquid supply pipe 30, although manual shut off valves (not shown) may be employed on all fluid pipes to facilitate isolation of different components for removal and servicing. Optional control valve 35 (shown in dashed lines) may be employed in a system when it is desirable to have further devices for controlling the proportion of liquid and vapor supplied to pump 20, for achieving a broader range of flow rates through pump 20. That is, optional control valve 35 can be used by itself or in combination with other devices for controlling the proportion of liquid and vapor supplied to pump 20.

In a preferred embodiment, when valve 34 is a solenoid valve, it is electronically controlled by controller 36. Controller 36 may also be used to control the speed of linear actuator 28. Variable speed control of linear actuator 28 can be employed as a device for controlling flow rate through the apparatus. Controller 36 may be a controller dedicated to controlling pump flow rate and pressure in storage tank 10 and accumulator vessel 40. In an alternative embodiment, controller 36 may be part of a multi-function controller that controls other system components in addition to the apparatus shown in FIG. 1. For example, when the apparatus is employed to supply fuel to an engine, controller 36 may be part of a larger device that controls some or all of the other engine systems. In other embodiments, an electronic controller is not required and the apparatus is operated to induce a substantially constant proportion of liquid and vapor by volume; that is, valve 34 or another mechanical element is employed to supply vapor to the pump for a constant portion of the induction stroke.

Figure 4:
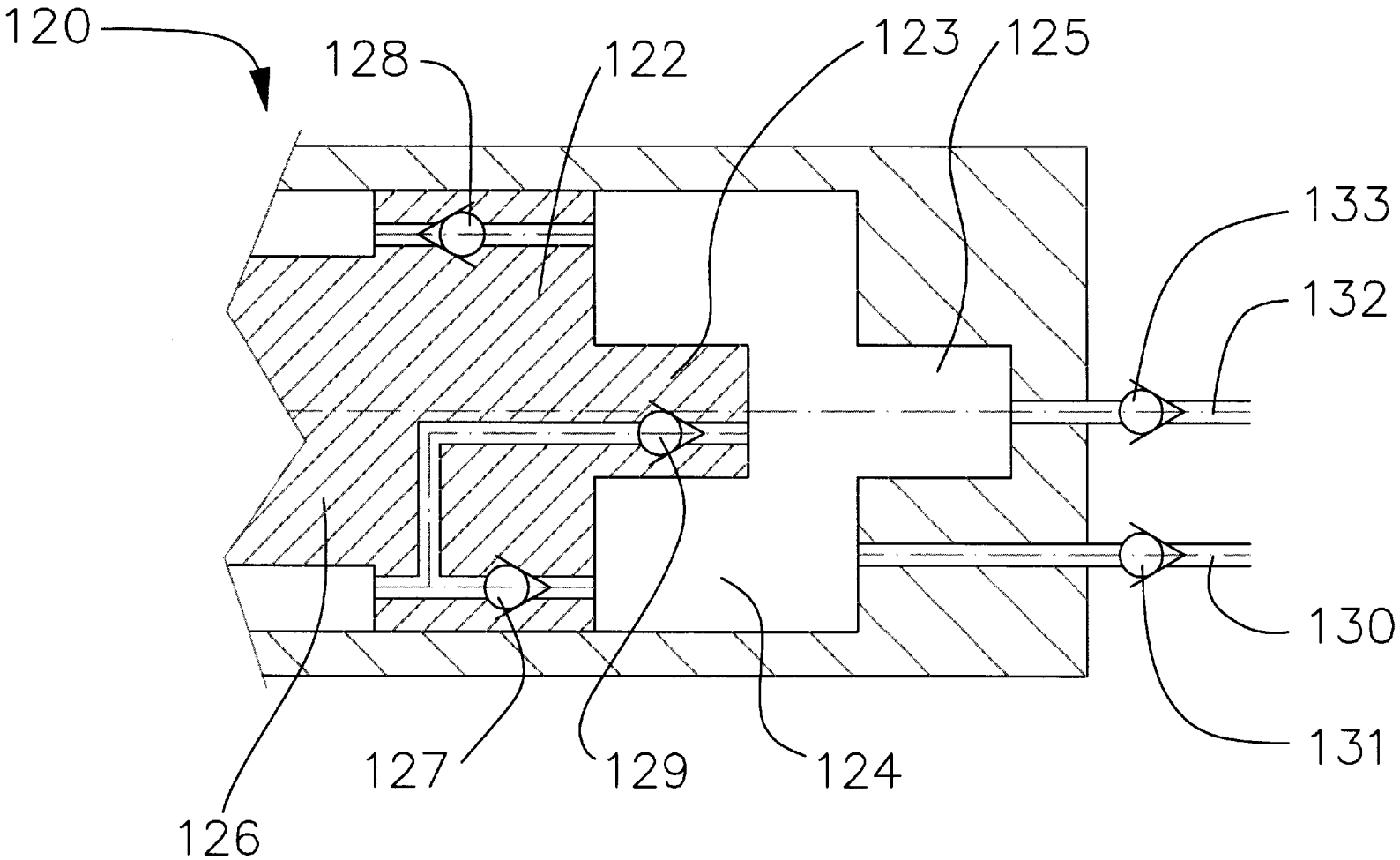
FIG. 4 is a schematic cross section of the end of a pump with separate vapor and liquid supply pipes, which illustrates an embodiment for inducing a fixed proportion of vapor and liquid, by volume, in each induction stroke.

FIG. 4 illustrates an example of a pump arrangement that could be employed to supply the pump with a substantially constant proportion of liquid and vapor (by volume) without a controller. In FIG. 4, pump 120 includes a piston 122, which includes an extension 123. Piston 122 is driven by piston rod 126 so that piston 122 reciprocates within piston chamber 124. Extension 123 is insertable into well 125, which is formed in the suction end of pump 120. A close tolerance fit may be combined with a seal (not shown) to provide sealing between the parallel surfaces of extension 123 and well 125 so that when extension 123 is inserted into well 125, flow of vapor through vapor supply pipe 132 is substantially blocked.

Liquid supply pipe 130 supplies liquid into piston chamber 124 through one-way valve 131 at the beginning of the induction stroke. As the induction stroke progresses, extension 123 is withdrawn from well 125 and vapor fills substantially the remainder of the expanding volume of piston chamber 124.

During the compression stroke, one-way valves 131 and 133 prevent fluid from being forced into liquid supply pipe 130 and vapor supply pipe 132 respectively. The vapor within piston chamber 124 is compressed and condensed and the liquid may also be compressed to increase the pressure of the fluid prior to being discharged from piston chamber 124 through one-way valves 127 and 129. When the discharged fluid is directed to another stage with a smaller piston chamber, the excess fluid may be returned to piston chamber 124 through pressure relief valve 128.

Persons skilled in the technology involved here will understand that other arrangements are possible without departing from the spirit of this embodiment. For example, vapor inlet ports may be provided in the walls of the piston chamber where they are revealed as the piston travels past them, much like the port arrangements used for two-stroke engines.

The pump of FIG. 4 need not employ a controller such as the one shown in FIG. 1. However, in other embodiments, a controller can be employed to adjust the proportion of liquid and vapor to provide more flexibility for controlling the flow rate through the pump. With reference again to FIG. 1, electronic controller 36 is employed to receive input signals from pressure sensor 42, position sensor 50, and, optionally, pressure sensor 12. Controller 36 may be employed to control at least one device for adjusting the flow rate through the apparatus and/or the proportion of liquid and vapor induced into the pump during each induction stroke.

Position sensors suitable for detecting the position of piston 22 are well known in the art. In a preferred embodiment, position sensor 50 is a linear position transducer that detects the position of piston 22 and sends a representative signal to controller 36. Position sensor 50 may be associated with pump 20 or any component of the drive system for the pump. For example, sensor 50 may detect the position of a reference point on the piston rod that connects piston 22 to linear actuator 28, or sensor 50 may monitor a condition of linear actuator 28 that correlates to the position of piston 22. For example, when linear actuator 28 is a linear hydraulic motor, position sensor 50 may monitor the flow of hydraulic fluid or the position of a hydraulic piston.

Sensor 50 determines the position of piston 22 during the induction stroke so that controller 36 opens valve 34 when piston 22 is in the appropriate position to achieve the desired proportion of liquid and vapor in each induction stroke.

Controller 36 determines the desired flow rate and pump speed, which dictates the proportion of liquid and vapor to supply to piston chamber 24 for each induction stroke. Controller 36 preferably makes this determination according to predetermined operating criteria based upon the input signals; for example, flow rate through pump 20 is controlled to maintain pressure downstream from pump 20 within a predetermined pressure range and, optionally, pressure within storage tank 10 below a predetermined pressure. For a given set of operating conditions controller 36 determines the appropriate piston position for supplying vapor to pump 20. A minimum amount of liquid is required in each pump cycle to ensure that substantially all of the vapor drawn into the pump is condensable and that the temperature and pressure of the fluid at the end of the compression stroke is not too high. The actual minimum amount of liquid in each induction stroke depends upon a number of variable operating conditions, but for example, it has been found that as low as 10 to 20% liquid by volume is sufficient to condense the vapor that is induced into the remaining volume while maintaining sufficiently low pressure and temperature. Controller 36 may make its determinations with reference to a look up table or by using an algorithm.

In simplified systems, instead of an electronic controller, a mechanical controller may be employed to supply a substantially constant proportion of liquid and vapor, measured by volume, by supplying vapor to pump 20 whenever piston 22 reaches a predetermined position during the induction stroke.

Figure 2C:
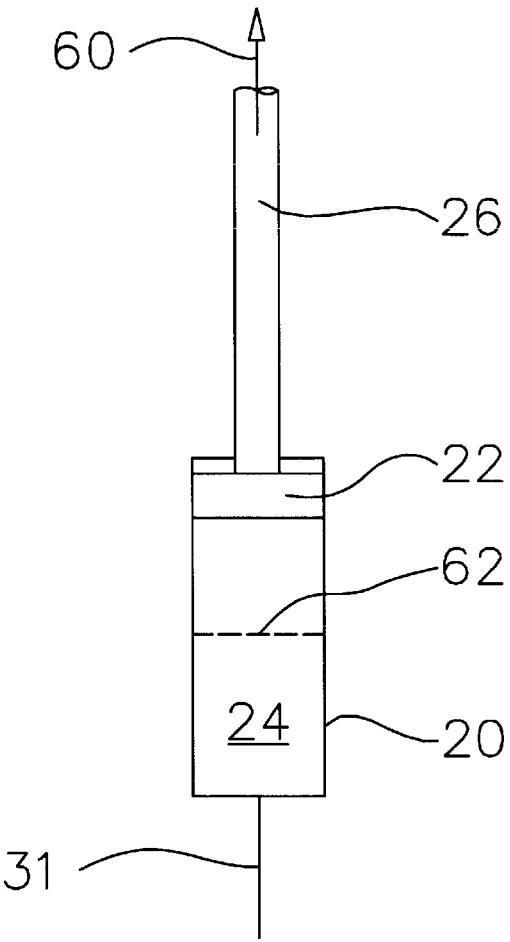
FIGS. 2A, 2B and 2C are schematic cross sections of a reciprocating pump that show views of the same pump with the piston at successive positions during an induction stroke.
Figure 2B:
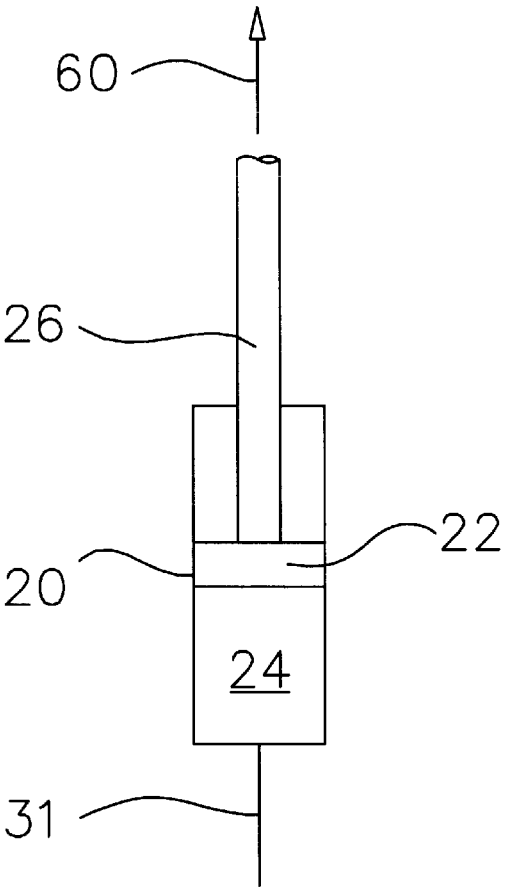
Figure 2A:
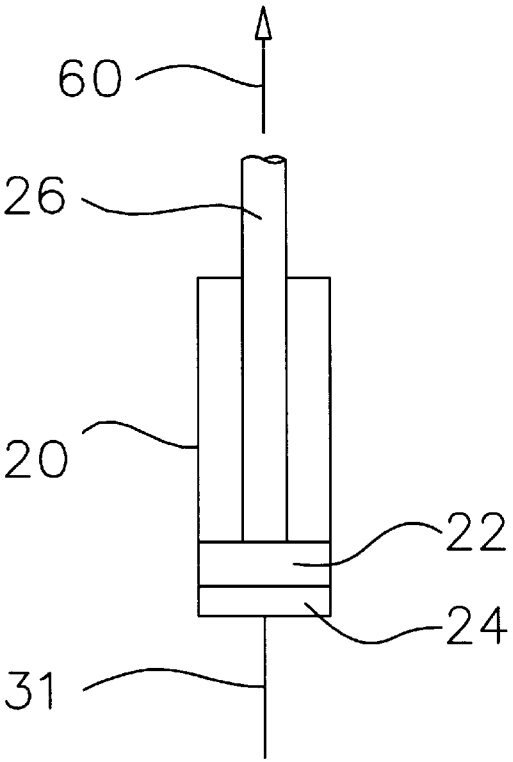

FIGS. 2A, 2B and 2C depict pump 20 of FIG. 1. In a preferred method, controller 36 controls the flow rate through pump 20 by controlling the flow capacity. Flow capacity is controlled by operating valve 34 to control the proportion of liquid and vapor supplied to piston chamber 21 during each induction stroke. In FIG. 2A, an induction stroke has just begun and piston 22 is moving in the direction of arrow 60. Valve 34 (shown in FIG. 1) is closed and only liquid is being drawn from storage tank 10 through suction pipe 31 to fill piston chamber 24.

In FIG. 2B, piston 22 is shown at an intermediate position during the induction stroke. That is, piston 22 may be at any location between the start and end piston positions for the induction stroke. Controller 36 determines the desired proportion of liquid and vapor with reference to pressure at a point downstream from pump 20. FIG. 2B represents the point in the induction stroke when controller 36 determines that the desired amount of liquid has been drawn into piston chamber 24, and controller 36 opens valve 34 so that for the remainder of the induction stroke substantially only vapor is drawn into piston chamber 24 through suction pipe 31.

In FIG. 2C, piston 22 is shown just as it reaches the end position for the induction stroke. Line 62 represents the relative volumes of liquid and vapor based upon the position of piston 22 when controller 36 opened valve 34. In other induction strokes the proportion of liquid and vapor will change depending upon the position of piston 22 when controller 36 opens valve 34. To maximize flow capacity for a given induction stroke, valve 34 is kept closed for the entire induction stroke. To reduce flow capacity for a given induction stroke controller 36 opens valve 34 earlier in the induction stroke.

In FIG. 2, to simplify the explanation of how the proportion of liquid and vapor is controlled, the induction stroke is shown beginning with inducing liquid, and when the desired amount of liquid has been induced, inducing substantially only vapor. Persons skilled in the technology involved here will understand that the timing for inducing the liquid or vapor can be changed without changing the desired volume proportions of liquid and vapor as long as liquid or vapor is induced for the same respective amount of piston travel.

Figure 3:
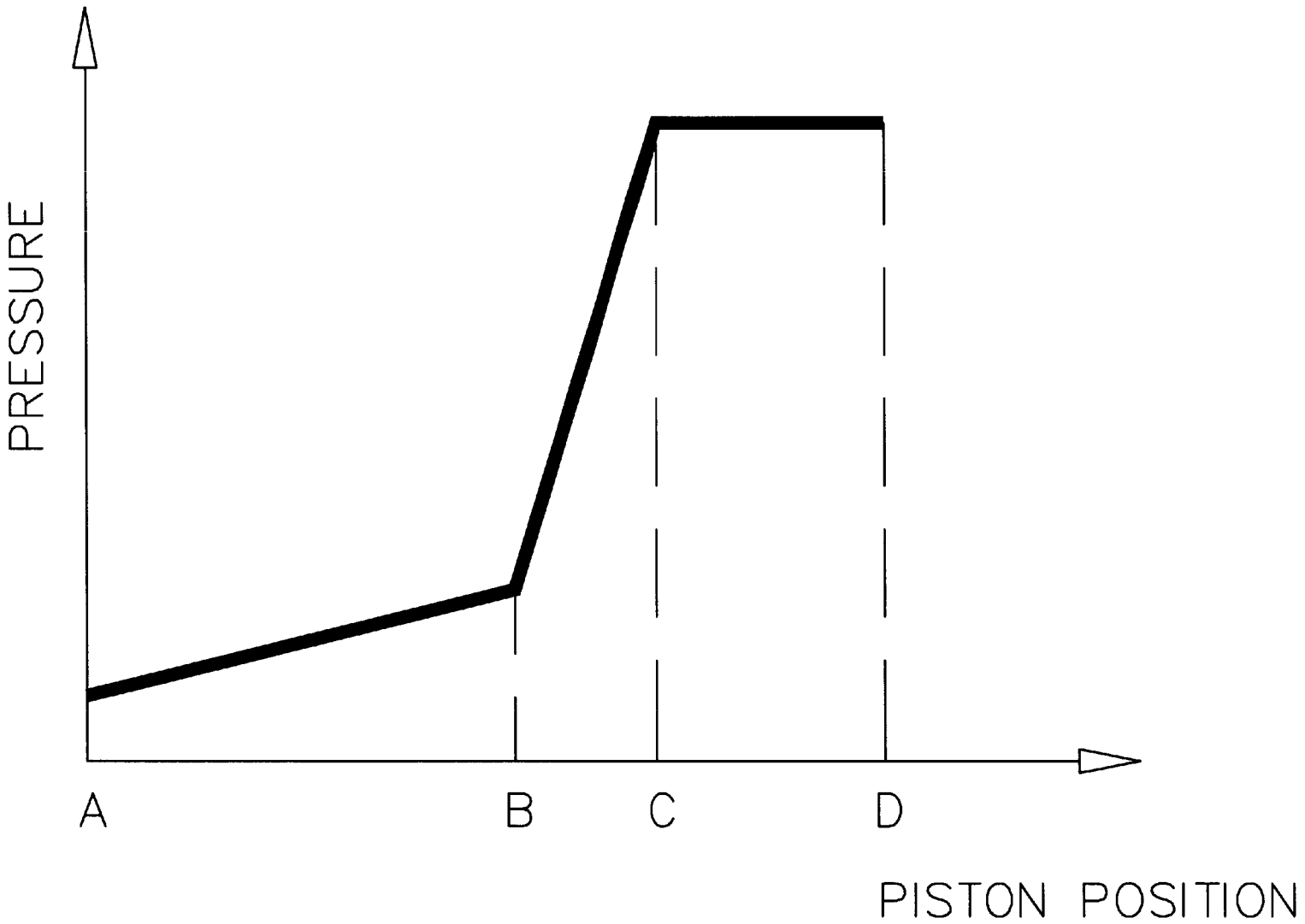
FIG. 3 is a graph that plots pressure against piston position to illustrate the pressure change within the piston chamber during a compression stroke.

After the completion of the induction stroke, piston 22 reverses direction and the compression stroke begins. At the beginning of the compression stroke vapor within piston chamber 24 is compressed and condensed as the volume of piston chamber 23 becomes smaller. The liquid is also compressed, and, as shown in FIG. 3, the pressure within piston chamber 24 rises sharply once substantially all of the vapor is condensed to liquid. FIG. 3 is a graph that plots pressure against piston position during the compression stroke. At the left side of the graph, at point A, piston 22 is at the beginning of the compression stroke and at the right side of the graph, at point D, piston 22 is at the end of the compression stroke. At point B substantially all of the vapor has been condensed and pressure begins to rise abruptly. At point C the fluid is compressed to the desired pressure and is discharged at that pressure. The piston position that corresponds to graphed points B and C will shift further to the right if a larger proportion of vapor is induced during the induction stroke, and conversely, these points will shift further to the left when a larger proportion of liquid is induced during the induction stroke.

The cryogenic fluid is finally discharged from piston chamber 24 through a pump outlet and discharge pipe 44, which directs the compressed fluid to heater 48 and then accumulator vessel 40. For a specific proportion of liquid and vapor, pump 20 will compress the fluid inducted into piston chamber 24 to the desired high pressure and then discharge the fluid from pump 20.

With reference once again to FIG. 1, the cryogenic fluid may be directed from accumulator vessel 40 and discharge pipe 44 to an application or end-user 46. For example, when the cryogenic fluid is a combustible fuel such as natural gas, end user 46 may be an internal combustion engine that uses the cryogenic fluid for fuel. When the cryogenic fluid is discharged from a high pressure pump it is a supercritical cryogenic fluid, and prior to directing the fluid to an internal combustion engine, it is desirable to convert the fluid into a gas. Heater 48 may be used to heat the fluid and convert it into gas.

For simplicity pump 20 is illustrated in the Figures as a single acting one-stage pump. Using a one-stage pump it is possible to pump liquid to high pressure. When a one-stage pump is employed to pump a mixture of liquid and vapor, discharge pressures of about 500 psig (about 3950 kPa) may typically be achieved, while at the same time removing vapor from a storage tank and thereby reducing the pressure in the tank and increasing holding time. However, persons skilled in the technology involved here will recognize that if more than one stage is employed, much higher discharge pressures can be achieved or the same pressures as a single stage pump can be achieved with equipment that can be made lighter and more suitable for the task. With a multi-stage pump the same control scheme can be used to control the pump flow capacity by regulating the proportion of liquid induced into the pump during each induction stroke. As already noted, the pump may be one of the types described in co-owned U.S. Pat. No. 5,884,488.

Pump 20 may be operated intermittently to maintain pressure within accumulator vessel 40 between predetermined values and vapor pressure within storage tank 10 below a predetermined vapor pressure. In a preferred method, pump 20 operates continuously with piston 22 travelling at a constant speed, with flow rate through pump 20 controlled by controlling the proportion of liquid and vapor induced during each induction stroke. An advantage of operating pump 20 at a constant speed is that extra controls and componentry for changing the speed of the pump are not required, thereby simplifying the hydraulic system and the control scheme, which may result in improved reliability. In yet another embodiment of the method, when the apparatus is employed to supply fuel to an engine, mechanical energy generated by the engine may be employed to drive a hydraulic pump for the hydraulic motor, so that the speed of the hydraulic motor and thus the speed of the pump correlate to engine speed. Since engine speed generally corresponds to fuel demand, with this arrangement, pump capacity automatically changes to match fuel requirements. Accordingly, by automatically changing pump speed as a function of engine speed, and also controlling the proportions of liquid and vapor, a wider range of flow rates between storage tank 10 and accumulator vessel 40 may be achieved.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A method of pumping cryogenic liquid and vapor from a storage tank with a reciprocating piston pump, said method comprising:

(a) in an induction stroke, retracting a piston disposed within said reciprocating pump and drawing cryogenic fluid from said storage tank into a piston chamber associated with said piston;

controlling flow rate through said pump by controlling the proportion of liquid and vapor supplied to said pump by supplying substantially only vapor during a selected portion of said induction stroke; and (b) in a compression stroke, compressing and condensing vapor and compressing any liquid within said piston chamber, and discharging compressed cryogenic fluid from said pump.

2. The method of claim 1 wherein for each pump cycle, minimum flow rate pumpable through said pump is determined by the minimum proportion of liquid that is needed during said compression stroke to allow condensation of said vapor within said piston chamber.

3. The method of claim 1 wherein said pump is a single stage pump and for each pump cycle, maximum flow rate pumpable through said pump is achievable by supplying only cryogenic liquid to said pump.

4. The method of claim 1 further comprising condensing vapor supplied from said storage tank in an inducer, and maximum flow rate pumpable through said pump is achievable by supplying a proportion of liquid and vapor to said inducer such that when said inducer completes a compression stroke, said pump piston chamber is substantially filled with liquid.

5. The method of claim 1 wherein flow rate through said pump is controlled to maintain pressure within a predetermined range at a point downstream from said pump.

6. The method of claim 5 further comprising monitoring vapor pressure within said storage tank and further controlling the proportion of vapor and liquid supplied to said pump to maintain vapor pressure within said storage tank below a predetermined value.

7. The method of claim 1 wherein the proportion of liquid and vapor supplied to said pump during said induction stroke is controlled by first supplying liquid until said piston reaches a position during said induction stroke that corresponds to a desired proportion of liquid and then supplying substantially only vapor to fill said piston chamber until said induction stroke is complete.

8. The method of claim 1 wherein cryogenic fluid discharged from said pump is directed to a heater for transforming said cryogenic fluid into a gas.

9. The method of claim 1 wherein said desired proportion of liquid, measured by volume, is constant, such that vapor is supplied to said pump during a predetermined portion of said induction stroke.

10. The method of claim 1 wherein said cryogenic fluid is a combustible fuel and said method further comprises supplying said combustible fuel to an engine.

11. The method of claim 1 wherein the supply of vapor to said piston chamber during said induction stroke is controlled by operating an automatically actuated valve associated with a vapor supply pipe that connects an ullage space of said tank with said pump, said method comprising opening said valve to supply substantially only vapor to said pump and closing said valve to supply substantially only liquid to said pump.

12. The method of claim 11 wherein flow rate through said pump is controlled by controlling when said valve is opened with reference to the position of said piston, and flow rate is increasable by opening said valve for a smaller portion of said induction stroke.

13. The method of claim 12 wherein the position of said pump piston is determined by a sensor that sends an electronic signal to an electronic controller.

14. The method of claim 13 wherein said sensor comprises a linear position transducer associated with said piston.

15. The method of claim 11 wherein said valve is a solenoid valve.

16. The method of claim 15 wherein an electronic controller controls said solenoid valve for achieving a desired pump flow rate while reducing vapor pressure within said storage tank.

17. The method of claim 12 further comprising driving said pump with a linear hydraulic motor.

18. The method of claim 17 wherein the position of said pump piston is determined by monitoring said linear hydraulic motor.

19. The method of claim 17 wherein the position of said pump piston is determined by monitoring a piston rod disposed between said pump piston and said linear hydraulic motor.

20. The method of claim 1 whereby, in addition to controlling flow rate by controlling the proportion of liquid and vapor supplied to said pump, flow rate of said cryogenic fluid may be further controlled by changing pump speed.

21. The method of claim 1 whereby, vapor is supplied to said pump from said storage tank for a fixed portion of said induction stroke and the proportion of liquid and vapor supplied to said pump is controlled by controlling the flow rate of liquid supplied to said pump when vapor is not being supplied from said storage tank.

22. The method of claim 1 whereby, in addition to controlling flow rate by controlling the proportion of liquid and vapor supplied to said pump, flow rate may be further controlled when said pump is a variable displacement pump and displacement is changeable to influence flow rate through said pump.

23. A method of pumping a cryogenic fluid from a storage tank with a reciprocating piston pump, said method comprising:

in an induction stroke, retracting a piston within said reciprocating pump and drawing cryogenic fluid from said storage tank into a piston chamber associated with said piston;

supplying vapor from said storage tank to said pump through a vapor supply pipe when a valve associated with said vapor supply pipe is open;

supplying cryogenic liquid from said storage tank to said pump through a liquid supply pipe when said valve is closed;

reducing vapor pressure within said storage tank and controlling pump flow rate by controlling the timing for opening said valve during said induction stroke; and (b) in a compression stroke, reversing the direction of said piston to compress and condense vapor and compress the cryogenic liquid within said piston chamber; and discharging compressed cryogenic fluid from said pump.

24. The method of claim 23 wherein said pump draws substantially only cryogenic liquid into said piston chamber when said valve is closed and draws substantially only vapor when said valve is open.

25. The method of claim 23 wherein timing for opening said valve is determined by a controller with reference to pressure measured at a point downstream from said pump to which said compressed cryogenic fluid is directed.

26. An apparatus for pumping a cryogenic fluid from a storage tank and reducing vapor pressure within said storage tank, said apparatus comprising:

(a) a reciprocating pump for pumping said cryogenic fluid supplied from said storage tank;

(b) a liquid supply pipe that fluidly connects said storage tank to an inlet of said pump;

(c) a vapor supply pipe that fluidly connects an ullage space within said storage tank to said inlet;

(d) an automatically actuated valve associated with said vapor supply pipe, said valve being operable between a closed and an open position for allowing vapor to flow through said vapor supply pipe when said valve is in said open position;

(e) a controller for determining when to open said valve during an induction stroke of said pump, said controller making such determination to achieve a desired flow rate; and (f) a position sensor for determining the position of a piston of said pump, said position sensor in communication with said controller so that said controller opens said valve when said piston is in a position to corresponds to the desired proportion of liquid for said induction stroke.

27. The apparatus of claim 26 wherein said position sensor comprises a linear position transducer associated with said piston.

28. The apparatus of claim 26 wherein said valve is a solenoid valve.

29. The apparatus of claim 26 further comprising a linear hydraulic motor for driving said pump.

30. The apparatus of claim 26 further comprising an accumulator vessel that is fluidly connected to a discharge port of said pump.

31. The apparatus of claim 30 wherein said cryogenic fluid is a combustible fuel.

32. The apparatus of claim 31 further comprising a heater for heating cryogenic fluid discharged from said pump.

33. The apparatus of claim 26 further comprising an internal combustion engine that is fluidly connected to a discharge port of said pump, and said combustible fuel is usable as fuel for said engine.

34. The apparatus of claim 26 wherein said reciprocating pump is a single acting pump comprising a single piston reciprocable within a single piston chamber.

35. An apparatus for pumping a cryogenic fluid from a storage tank and reducing vapor pressure within said storage tank, said apparatus comprising:

(a) a reciprocating pump for pumping said cryogenic fluid supplied from said storage tank;

(b) a liquid supply pipe that fluidly connects said storage tank to an inlet of said pump;

(c) a vapor supply pipe that fluidly connects an ullage space within said storage tank to said inlet;

(d) an automatically actuated valve associated with said vapor supply pipe, said valve being operable between a closed and an open position for allowing vapor to flow through said vapor supply pipe when said valve is in said open position;

(e) a controller for determining when to open said valve during an induction stroke of said pump, said controller making such determination to achieve a desired flow rate; and (f) an inducer, which is fluidly disposed between said storage tank and said reciprocating pump, said inducer comprising an inlet for receiving cryogenic fluid from said storage tank, an inducer piston that is reciprocable within an inducer piston chamber for compressing and condensing cryogenic vapor and compressing cryogenic liquid; and said pump comprising an inlet for receiving compressed cryogenic fluid from said inducer, and a pump piston that is reciprocable within a pump piston chamber for further compressing said cryogenic fluid.

36. The apparatus of claim 35 further comprising a one-way flow conduit for transferring cryogenic fluid from said inducer piston chamber to said pump piston chamber.

37. The apparatus of claim 35 wherein when said pump piston chamber is filled with cryogenic fluid transferred from said inducer piston chamber, excess cryogenic fluid is recyclable within said inducer.

38. The apparatus of claim 35 wherein said inducer piston chamber is volumetrically larger than said pump piston chamber.

39. The apparatus of claim 38 wherein said inducer piston chamber has a volume that is at least two times larger than the volume of said pump piston chamber.

40. The apparatus of claim 38 wherein said inducer piston chamber has a volume that is between about four and seven times larger than the volume of said pump piston chamber.

41. The apparatus of claim 35 further comprising a linear hydraulic motor that drives both said inducer piston and said pump piston.

42. The apparatus of claim 40 further comprising a piston rod connecting said hydraulic motor with said inducer piston and said pump piston.

43. The apparatus of claim 35 wherein said inducer piston divides said inducer piston chamber into a first stage in communication with said inducer inlet and a second stage in communication with said pump piston chamber and a one-way flow conduit allows cryogenic fluid to flow from said first stage to said second stage, another one-way flow conduit allows cryogenic fluid to flow from said second stage to said pump piston chamber, and a pressure actuated valve allows cryogenic fluid to flow from said second stage to said first stage when pressure within said second stage exceeds a predetermined value.

* * * * *

UNITED STATES PATENT AND TRADEMARK OFFICE

CERTIFICATE OF CORRECTION

PATENT NO. : 6,640,556 B2
DATED : November 4, 2003
INVENTOR(S) : Milhai Ursan and Anker Gram It is certified that error appears in the above-identified patent and that said Letters Patent is hereby corrected as shown below:

Column 13,
Line 30, delete “apparatus of claim 31” and insert -- apparatus of claim 30 --.

Signed and Sealed this

Third Day of August, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,640,556 B2
DATED : November 4, 2003
INVENTOR(S) : Milhai Ursan and Anker Gram It is certified that error appears in the above-identified patent and that said Letters Patent is hereby corrected as shown below:

Column 13,
Line 30, delete “apparatus of claim 26” and insert -- apparatus of claim 30 --.

This certificate supersedes Certificate of Correction issued August 3, 2004.

Signed and Sealed this

Nineteenth Day of October, 2004

JON W. DUDAS
*Director of the United States Patent and Trademark Office*